US008186662B2

(12) United States Patent
Matsuyama et al.

(10) Patent No.: US 8,186,662 B2
(45) Date of Patent: May 29, 2012

(54) SHEET MONITOR FOR FOLDING MACHINE

(75) Inventors: Shinya Matsuyama, Noda (JP); Akira Ishikawa, Noda (JP)

(73) Assignee: Komori Corporation, Tokyo (JP)

( * ) Notice: Subject to any disclaimer, the term of this patent is extended or adjusted under 35 U.S.C. 154(b) by 446 days.

(21) Appl. No.: 12/464,331

(22) Filed: May 12, 2009

(65) Prior Publication Data

US 2009/0295057 A1 Dec. 3, 2009

(30) Foreign Application Priority Data

May 28, 2008 (JP) ..... 2008-138968

(51) Int. Cl.
*B41F 13/58* (2006.01)

(52) U.S. Cl. ..... 270/4; 271/227

(58) Field of Classification Search ..... 399/395; 400/579; 270/4, 20.1; 271/226, 227, 229
See application file for complete search history.

(56) References Cited

U.S. PATENT DOCUMENTS 5,628,718 A * 5/1997 Huober ..... 493/29
5,749,823 A * 5/1998 Richards ..... 493/417
6,135,446 A * 10/2000 Thiemann et al. ..... 271/228
6,226,070 B1 * 5/2001 Yamamoto ..... 355/40
6,440,049 B1 * 8/2002 Belanger et al. ..... 493/14
7,184,153 B2 * 2/2007 Leonhardt ..... 358/1.12
2005/0175386 A1 * 8/2005 Romine ..... 400/579

FOREIGN PATENT DOCUMENTS

EP 0639523 A1 2/1995
JP 2000-95431 A 4/2000
JP 2003-182883 A 7/2003

* cited by examiner

*Primary Examiner* — Ren Yan
(74) *Attorney, Agent, or Firm* — Birch, Stewart, Kolasch & Birch, LLP

(57) ABSTRACT

A folding machine includes: pairs of upper and lower downstream-side conveying belts (18B), the pairs being provided at intervals in a direction perpendicular to a conveying direction of a signature (Wb) and conveying the signature while holding the signature therebetween; stoppers (32) provided between the downstream-side conveying belts and stopping the signature conveyed by the downstream-side conveying belts by contacting therewith; and a chopper blade (19*a*) folding the signature stopped by the stoppers (32) in a direction parallel to the conveying direction. In the folding machine, a pair of right and left cameras (30A and 30B) are provided, which take images respectively of ranges where a conveying direction leading edge of one side edge and a conveying direction leading edge of the other side edge, the side edges being parallel to the conveying direction of the sheet, are decelerated or stopped by contacting with the stoppers (32).

6 Claims, 17 Drawing Sheets

SHEET MONITOR FOR FOLDING MACHINE

TECHNICAL FIELD

The present invention relates to a sheet monitor for a folding machine attached to a rotary offset printing press.

BACKGROUND ART

A rotary offset printing press includes a folding machine which cuts a web into pieces of a predetermined length and folds the web in a width direction and in a length direction, after the web is printed by a print unit and dried and cooled by a drying and cooling unit (see, for example, Patent Literature 1).

Folding methods implemented by the folding machine include: former folding for folding a web before being cut in two in a width direction by a former; single-parallel folding for folding a signature cut from the web in two in a length direction between a folding cylinder and a first jaw cylinder; double-parallel folding (folding in four) for further folding the single-parallel folded signature in two in the length direction between the first jaw cylinder and a second jaw cylinder; delta-folding (rolling folding) for firstly folding a signature, at a one-third position in a width direction, in two in the length direction between the folding cylinder and the first jaw cylinder and then further folding the signature in two in the length direction between the first and second jaw cylinders; and chopper folding for folding the single-parallel folded, double-parallel folded or delta-folded signature in two in a direction parallel to a conveying direction of the signature by use of a chopper. These folding methods are selected to be used independently or in combination according to the specification of the signature.

Meanwhile, the signature to be chopper-folded by the chopper in the folding machine described above is conveyed to stoppers of the chopper while being held between each of multiple pairs of conveying belts, the pairs being provided at intervals in a direction perpendicular to the conveying direction.

However, since the signature is folded in the direction parallel to the conveying direction of the signature by a former located upstream of the chopper, the signature has two sides, in the direction parallel to the conveying direction, one of which is thick and the other of which is thin. Therefore, these two sides of the signature slip at different degrees on the conveying belts. As a result, the signature may be conveyed to the stoppers in a tilt state and may be obliquely folded by the chopper. Moreover, multiple stoppers are provided at intervals in the direction perpendicular to the conveying direction of the signature. Thus, when a signature made of weak paper is conveyed at a high speed, a portion of the signature striking against corners of the stoppers may be torn or scratched.

CITATION LIST

Patent Literature 1

Japanese Patent Application Publication No. 2000-95431

SUMMARY OF INVENTION

Technical Problem

To avoid this situation, the following measures have heretofore been taken. Specifically, after a signature is discharged from the folding machine, an operator picks up the signature and checks if the signature is obliquely folded. When the signature is obliquely folded, the angles of the stoppers are adjusted to come into contact with and thereby stop a signature at its leading edge on one side conveyed to the stopper earlier than the other side, before stopping the signature on the other side. Accordingly, the signature is set straight when it is folded by the chopper. Alternatively, vertical heights of stopper front guides provided at intervals in the direction perpendicular to the conveying direction of the signature are adjusted to apply larger brake force to one side of the signature conveyed earlier than the other. Thus, the leading edge in the conveying direction (conveying direction leading edge) of the signature is brought into contact with the stoppers at a right angle.

Moreover, when the signature is torn or scratched at a portion coming into contact with the stopper, measures are taken, including reducing a conveying speed at which the signature comes into contact with the stoppers by adjusting the vertical heights of the stopper front guides to apply larger brake force to the signature.

However, since the conventional measures require the operator to pick up and check the signature discharged as described above, the measures are burdensome to the operator. Moreover, it is inevitable to waste all signatures produced after the tilt or scratches described above occur and before the signature is picked up by the operator. This results in a large amount of waste sheets.

Therefore, it is an object of the present invention to solve the foregoing problems by allowing an operator to perform real-time monitoring on a behavior of a conveying direction leading edge of a sheet in a chopper folding device.

Solution to Problem

An aspect of the present invention provides a sheet monitor for a folding machine, including: a plurality of pairs of conveying belts, the pairs provided at intervals in a direction perpendicular to a conveying direction of a sheet and conveying the sheet while holding the sheet therebetween; a plurality of stoppers being provided between the plurality of pairs of conveying belts and stopping the sheet conveyed by the plurality of pairs of conveying belts by coming into contact with the sheet; and a chopper blade folding the sheet stopped by the stoppers in a direction parallel to the conveying direction of the sheet. The sheet monitor includes a pair of imaging means taking images respectively of a range where a conveying direction leading edge of one side edge parallel to the conveying direction of the sheet is decelerated or stopped by coming into contact with the stoppers, and a range where a conveying direction leading edge of the other side edge parallel to the conveying direction of the sheet is decelerated or stopped by coming into contact with the stoppers.

Moreover, in the sheet monitor for a folding machine, from obliquely above, the imaging means take images of the conveying direction leading edge of the one side edge parallel to the conveying direction of the sheet and the conveying direction leading edge of the other side edge parallel to the conveying direction of the sheet.

Moreover, in the sheet monitor for a folding machine, the imaging means take images once for each rotation of the folding machine.

Moreover, in the sheet monitor for a folding machine, the imaging means each take every image at a folding machine rotation phase different from that of the image immediately before taken.

Moreover, in the sheet monitor for a folding machine, the imaging means each take every image at a later point in the folding machine rotation phase than that of the image immediately before taken.

Moreover, the sheet monitor for a folding machine further includes: a display, and in the sheet monitor for a folding machine, images taken by the pair of imaging means are displayed side-by-side on the display.

Moreover, in the sheet monitor for a folding machine, the display displays the images, which are taken by the pair of imaging means in chronological order.

Moreover, in the sheet monitor for a folding machine, the display is provided in an operation stand operated by an operator.

Advantageous Effects of Invention

According to the present invention having the above configuration, based on the images taken by the imaging means, the operator can monitor in real time the behavior of the leading edge portion in the conveying direction of the sheet located within a range in which the leading edges in the conveying direction of the both side edges parallel to the conveying direction of the sheet come into contact with the stopper. Thus, the operator can promptly make a subsequent response. As a result, burden on the operator can be reduced and waste sheets can be reduced.

Moreover, images of the conveying direction leading edge of the one side edge parallel to the conveying direction of the sheet and the conveying direction leading edge of the other side edge parallel to the conveying direction of the sheet are taken from obliquely above. Thus, the tilt degree of the sheet can be accurately monitored without hindrance from the chopper folding device.

Moreover, the imaging means takes an image once for each rotation of the folding machine. Thus, recognition of images is facilitated unlike the case where one sheet is imaged more than once (so-called continuously shot) under high-speed rotation of the folding machine.

Moreover, the imaging means each take every image at a folding machine rotation phase different from that of the image immediately before taken. Thus, the behavior of the sheet can be comprehensively grasped.

Moreover, the imaging means each take every image at a later point in a folding machine rotation phase than that of the image immediately before taken. Thus, the behavior of the sheet can be recognized along the flow thereof. As a result, the operator can easily recognize the behavior.

Moreover, the display is provided to display the images taken by the pair of imaging means side-by-side. Thus, behaviors of the conveying direction leading edge of the one side edge parallel to the conveying direction of the sheet and the conveying direction leading edge of the other side edge parallel thereto can be easily compared.

Moreover, the display displays the images taken by the pair of imaging means in chronological order. Thus, the behavior of the sheet can be displayed as so-called frame advance images on the display. As a result, the operator can easily recognize the behavior.

Moreover, since the display is provided in an operation stand operated by the operator, monitoring by the operator is facilitated.

DESCRIPTION OF EMBODIMENTS

With reference to the drawings, a sheet monitor for a folding machine according to the present invention will be described in detail below based on an embodiment.

Examples

Figure 1:
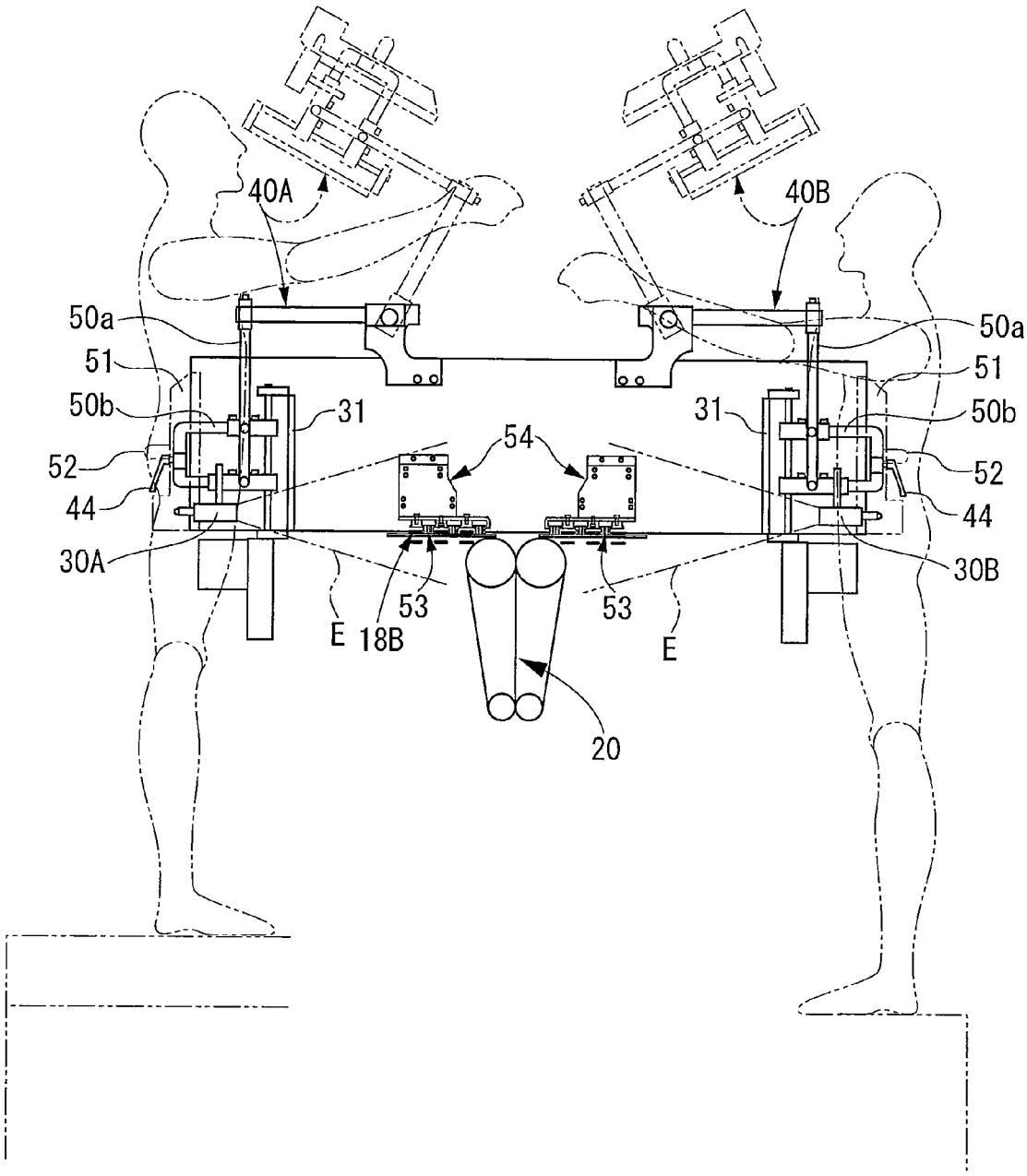
FIG. 1 is a back view of a chopper folding device in a folding machine according to an embodiment of the present invention.
Figure 2:
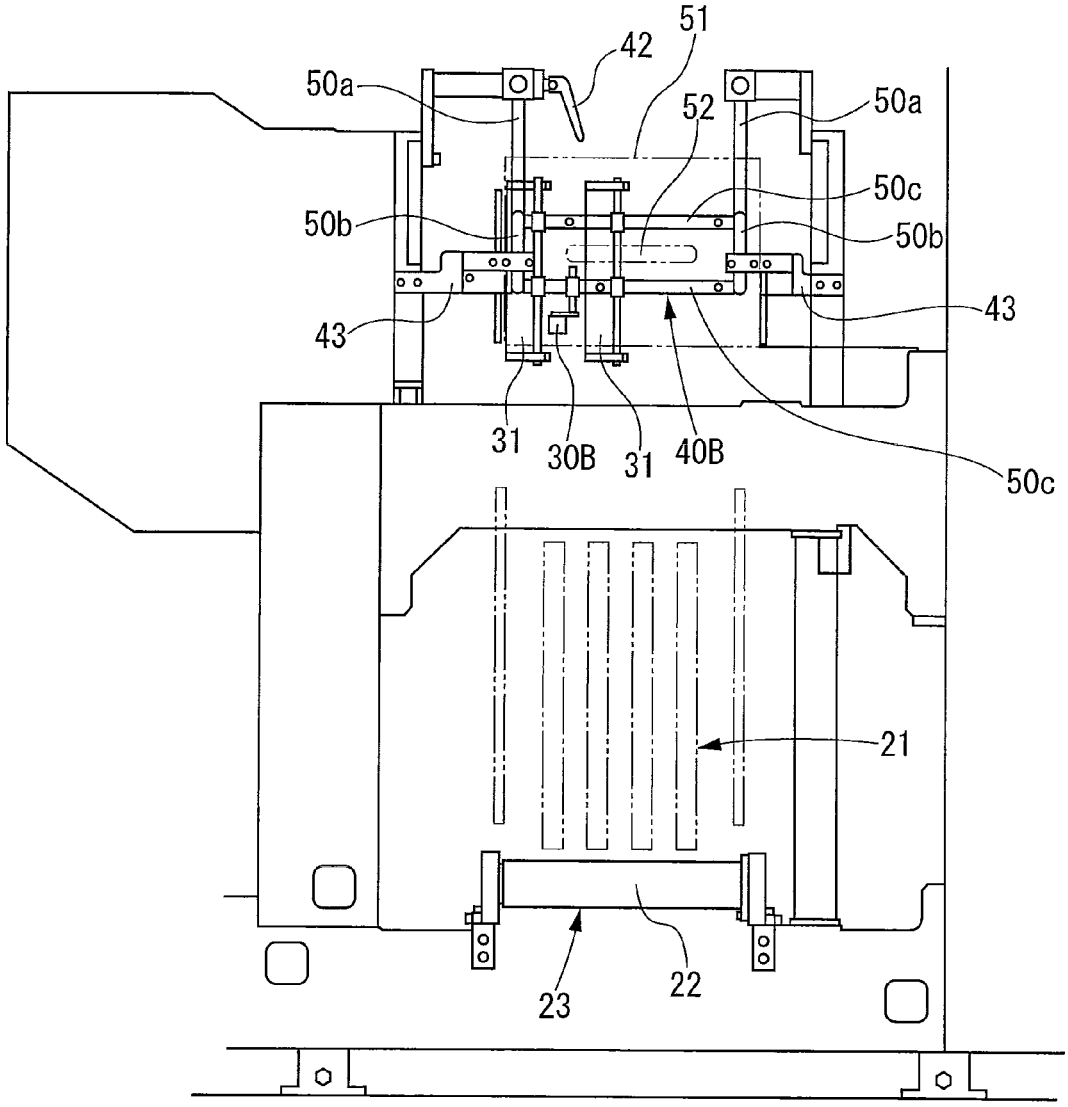
FIG. 2 is a side view of the chopper folding device in the folding machine.
Figure 3:
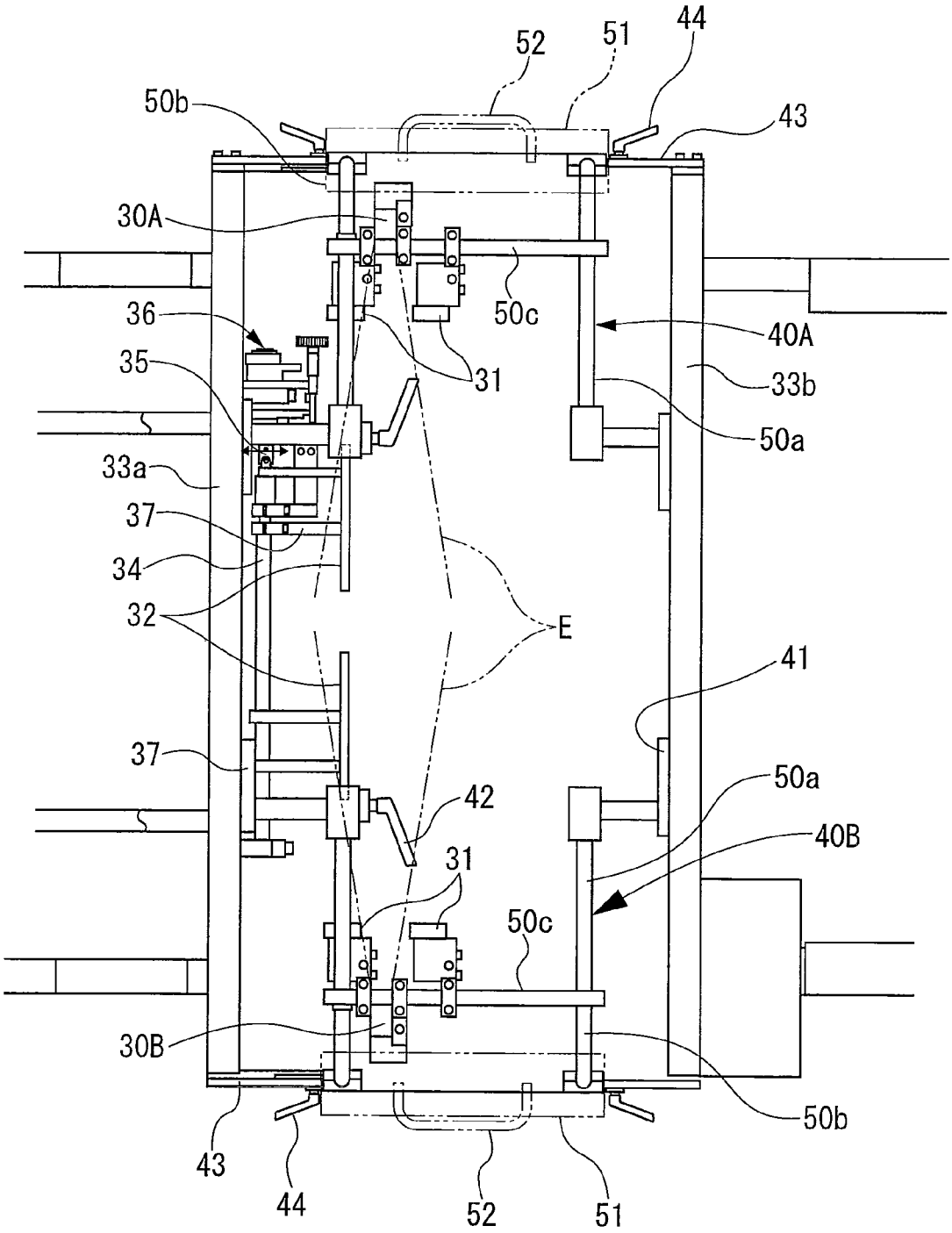
FIG. 3 is a plan view of the chopper folding device in the folding machine.
Figure 4A:
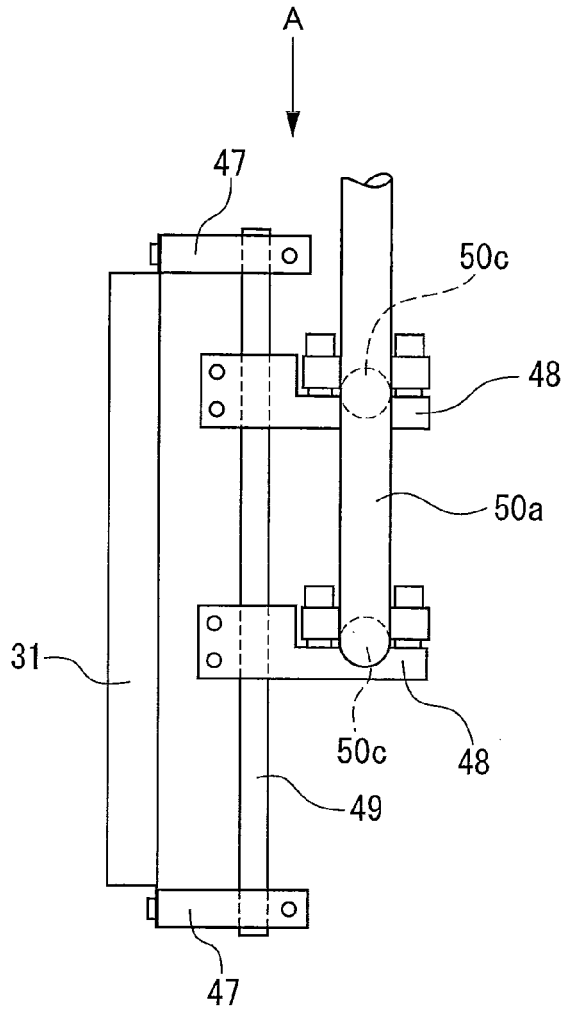
FIG. 4A is an explanatory view of a support mechanism of an LED illuminator.
Figure 4B:
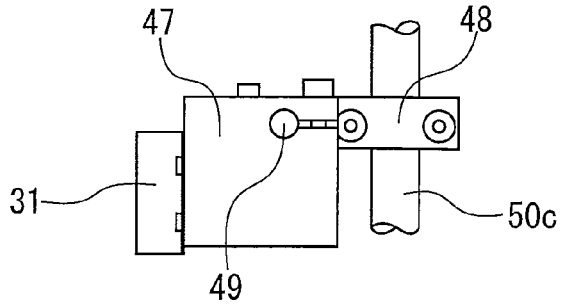
FIG. 4B is a view seen from an arrow A in FIG. 4A.
Figure 5A:
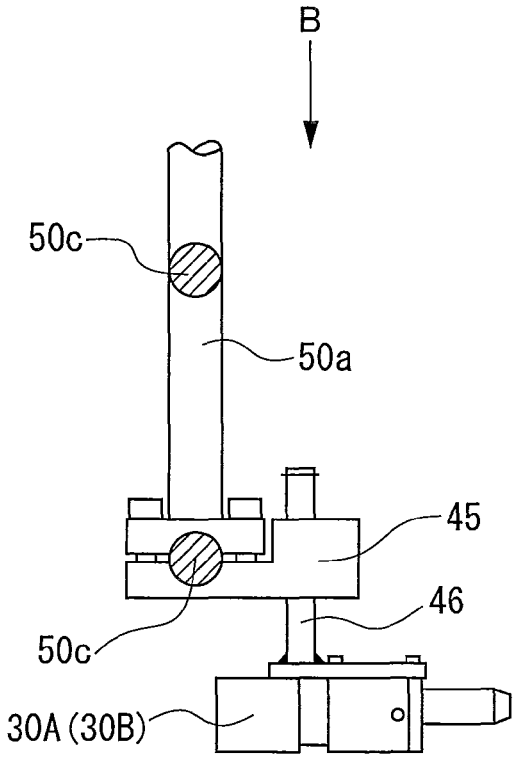
FIG. 5A is an explanatory view of a support mechanism of a camera.
Figure 5B:
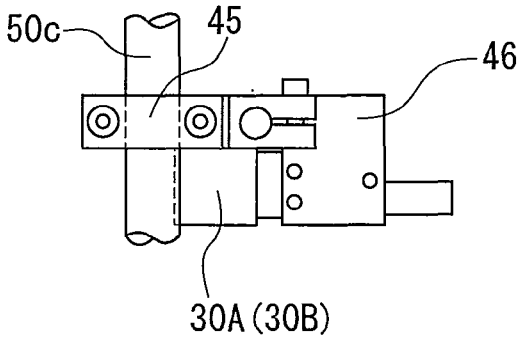
FIG. 5B is a view seen from an arrow B in FIG. 5A.
Figure 6:
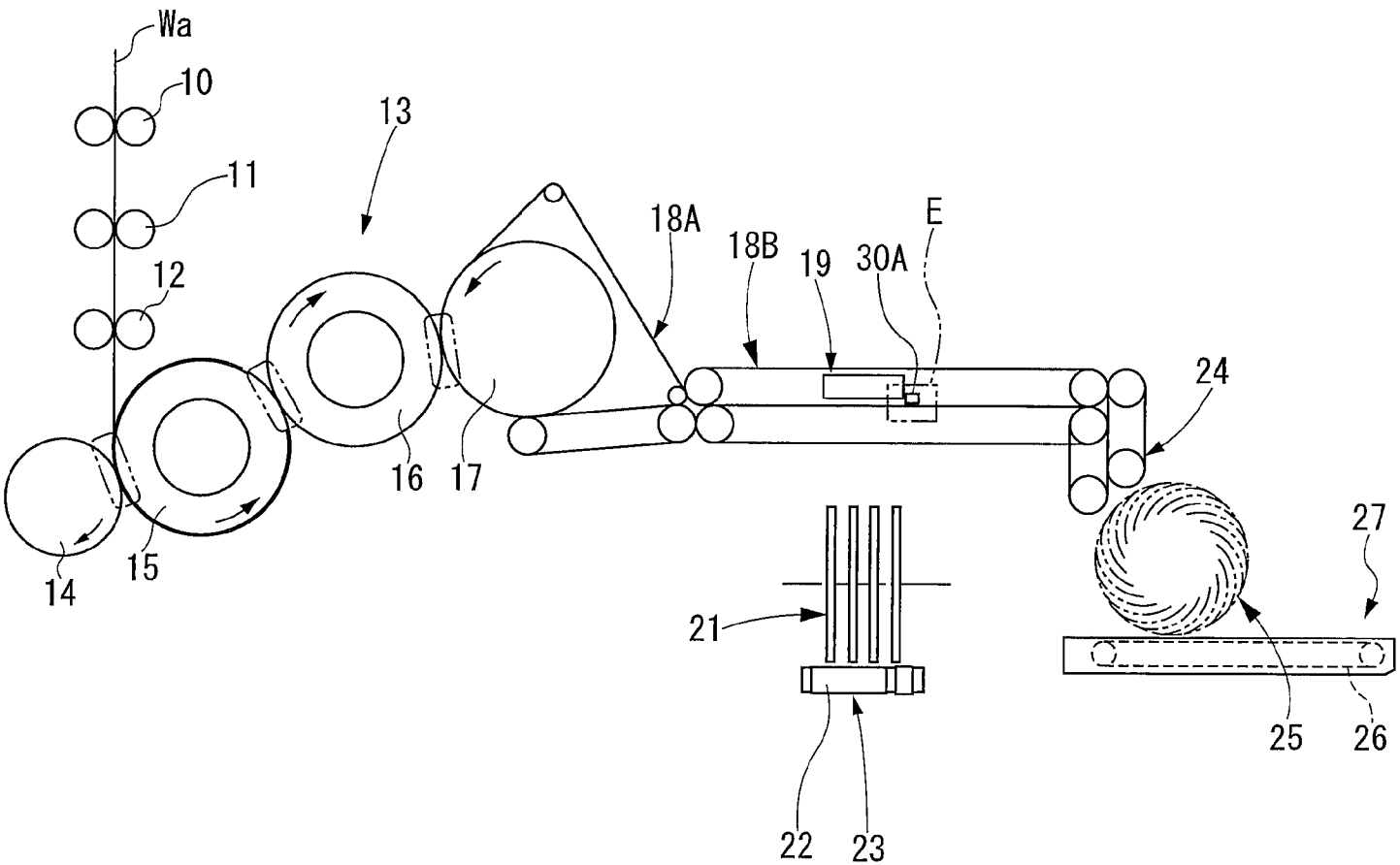
FIG. 6 is a side view of a schematic configuration of the folding machine.
Figure 7:
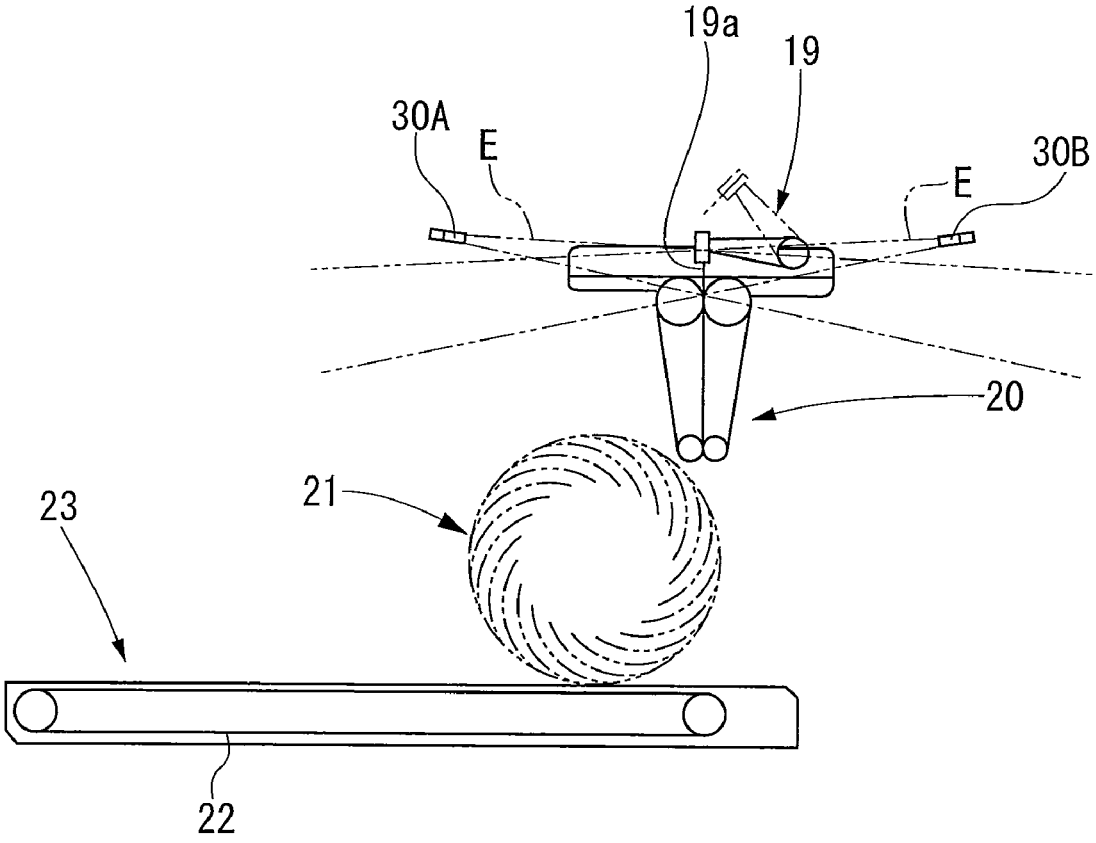
FIG. 7 is a back view of the schematic configuration of the folding machine.
Figure 8A:
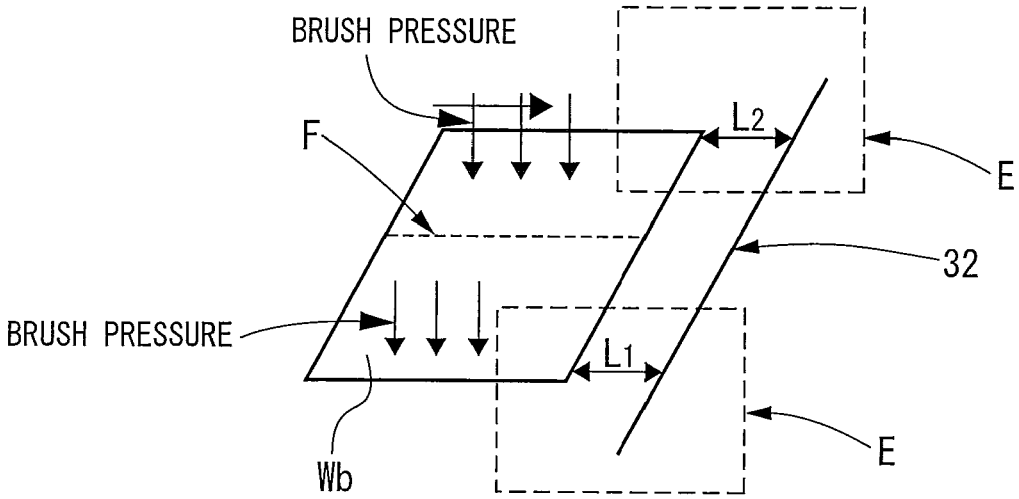
FIG. 8A is an explanatory view of an image showing a good behavior of a signature.
Figure 8B:
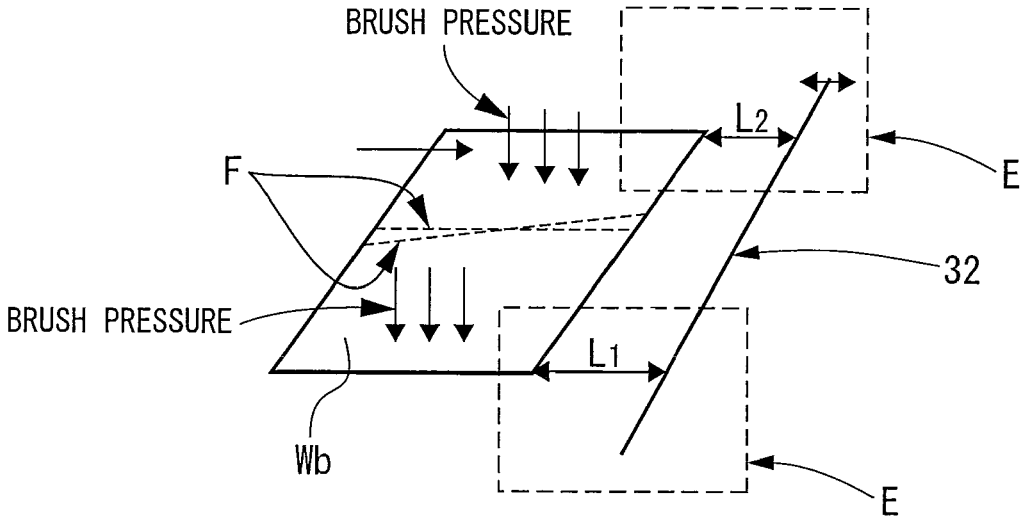
FIG. 8B is an explanatory view of an image showing a bad behavior of a signature.
Figure 9A:
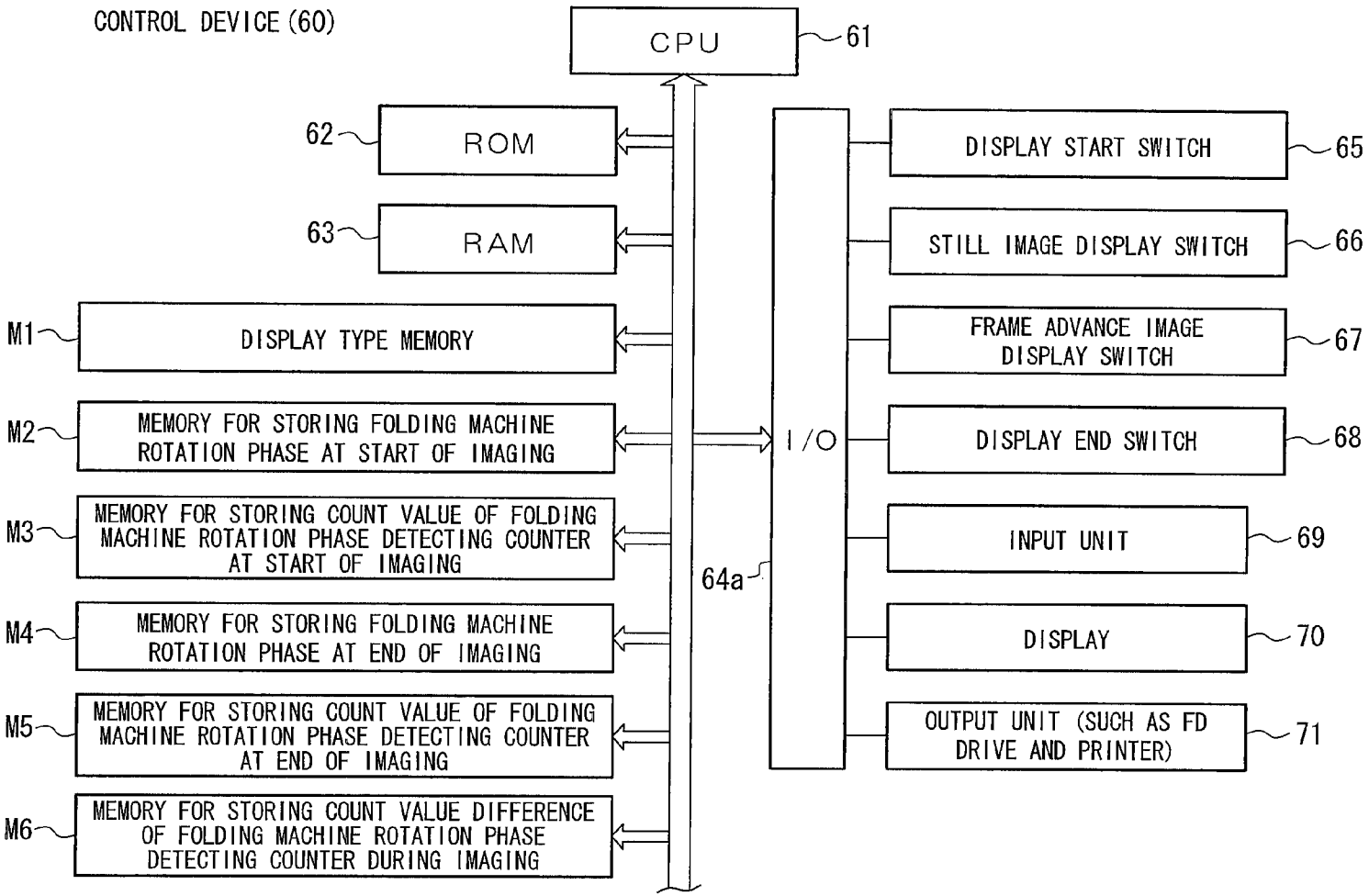
FIG. 9A is a block diagram of a control device.
Figure 9B:
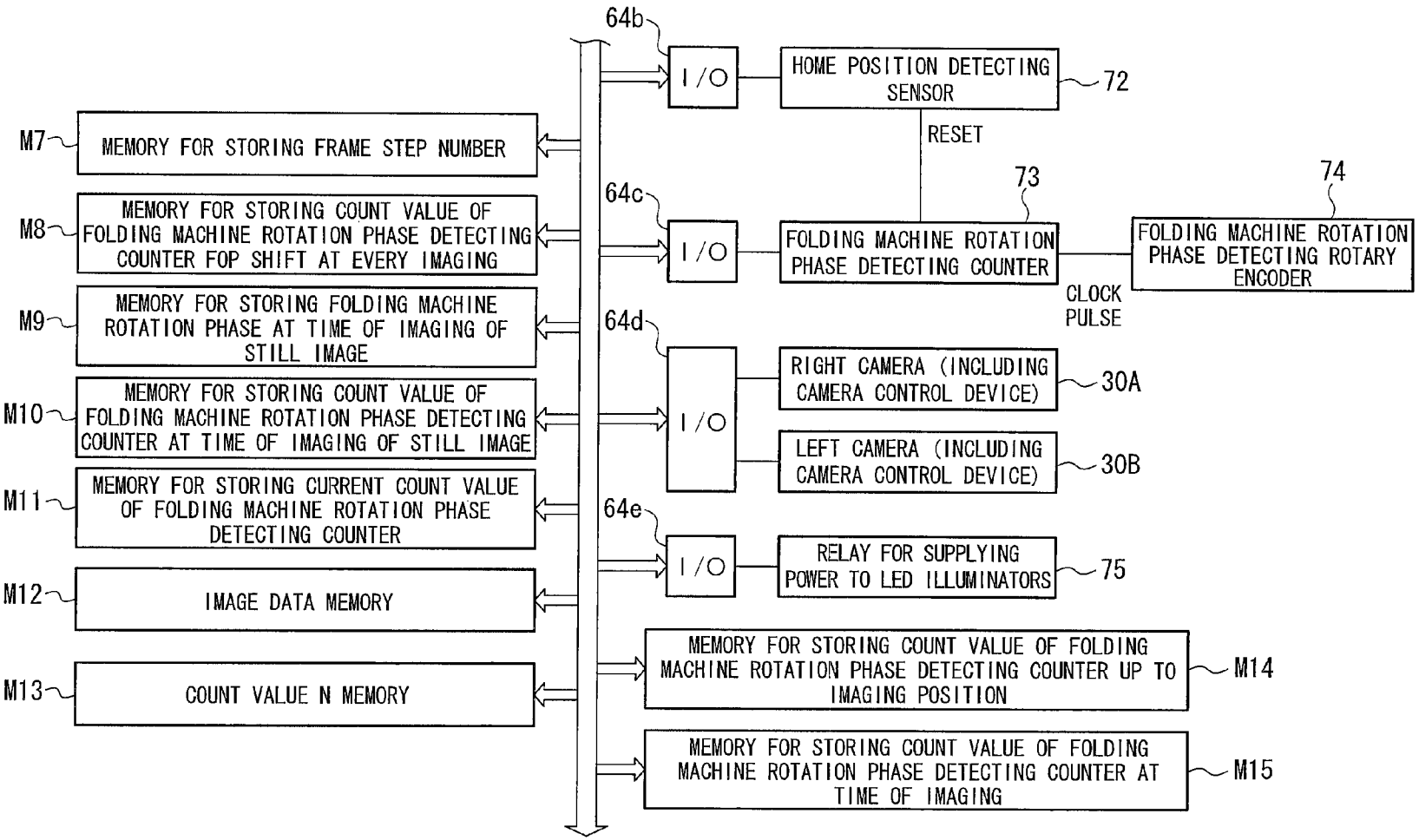
FIG. 9B is a block diagram of the control device.
Figure 10A:
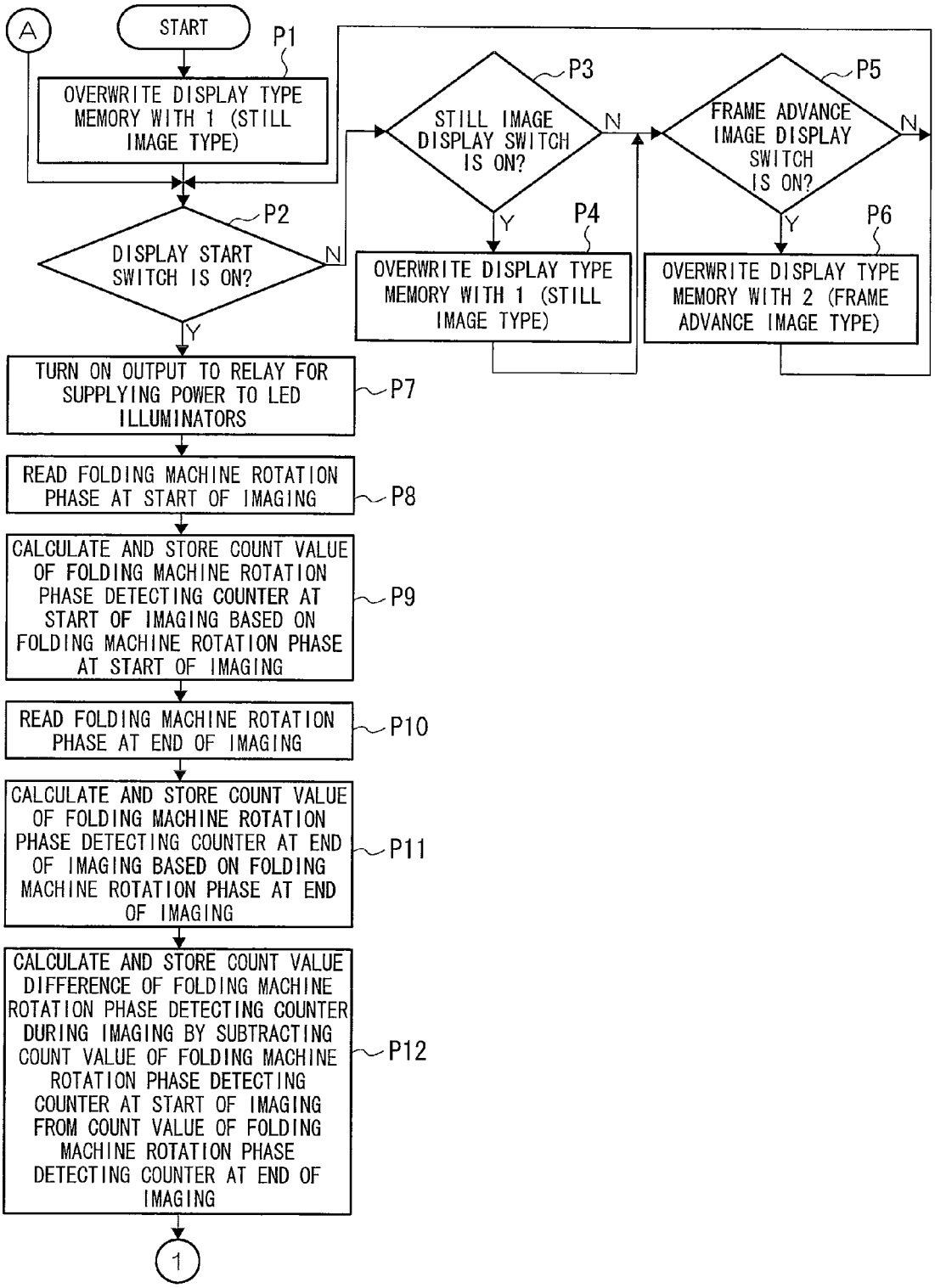
FIG. 10A is a flowchart showing operations of the control device.
Figure 10B:
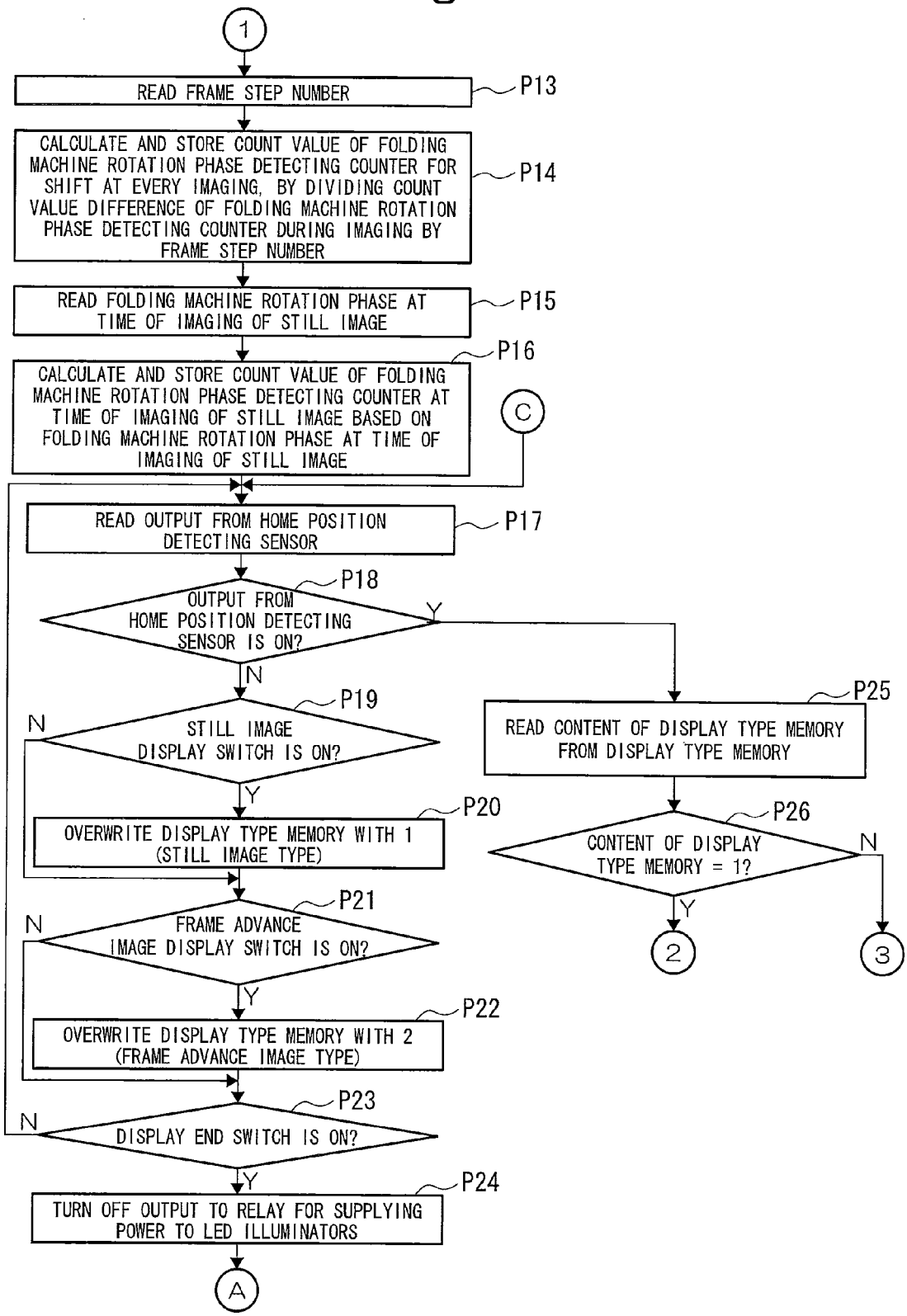
FIG. 10B is a flowchart showing operations of the control device.
Figure 10C:
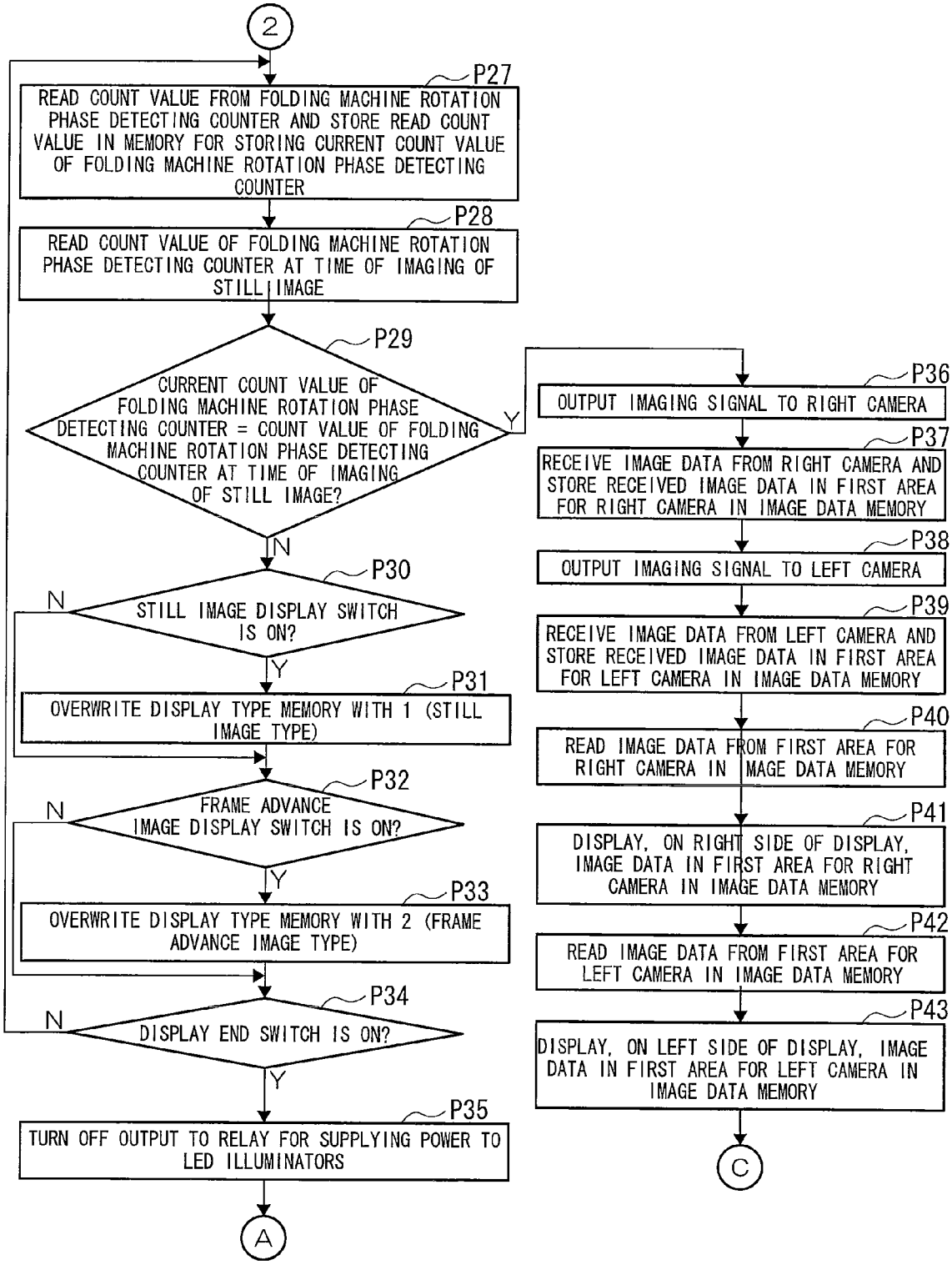
FIG. 10C is a flowchart showing operations of the control device.
Figure 10D:
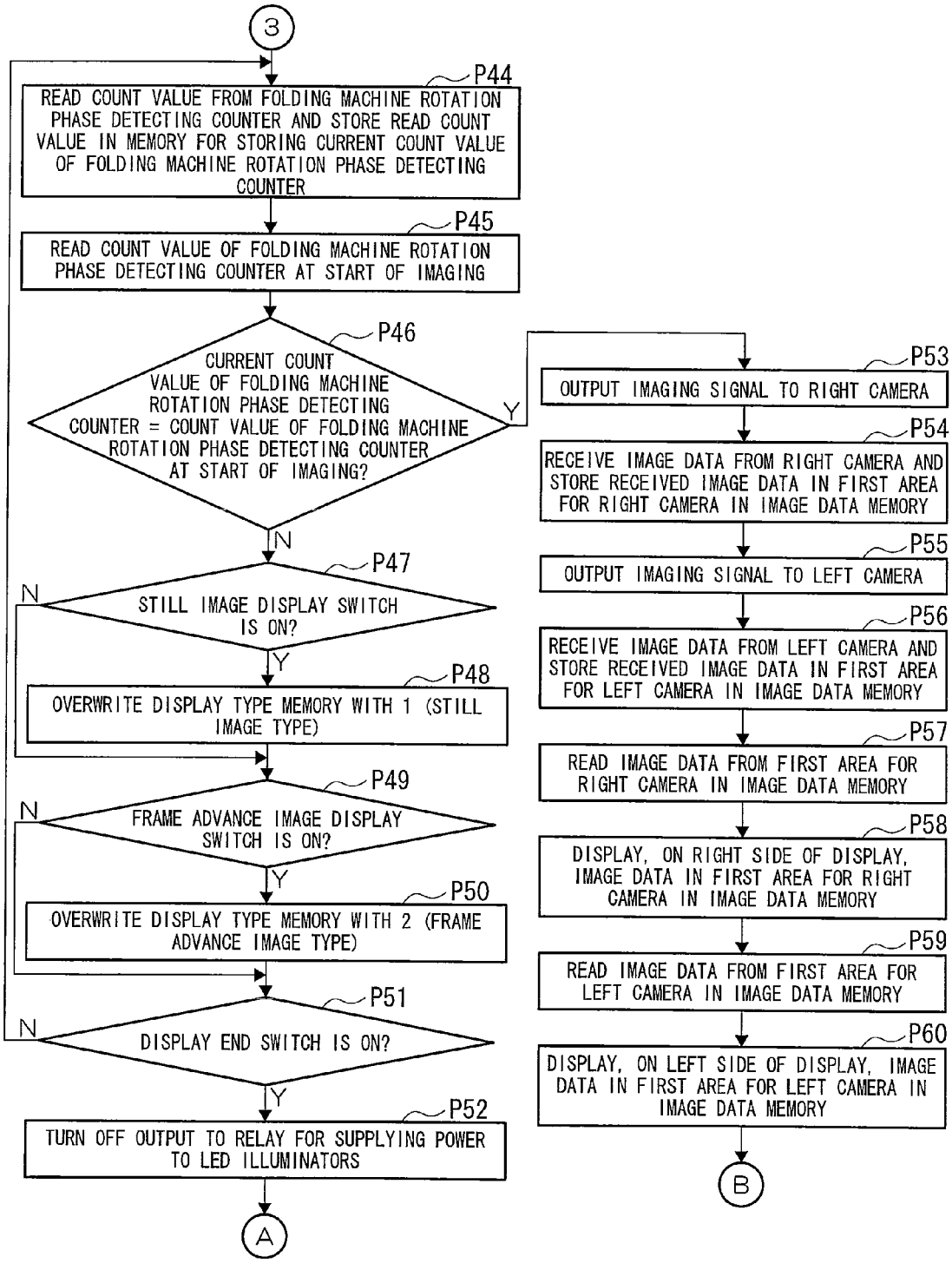
FIG. 10D is a flowchart showing operations of the control device.
Figure 11A:
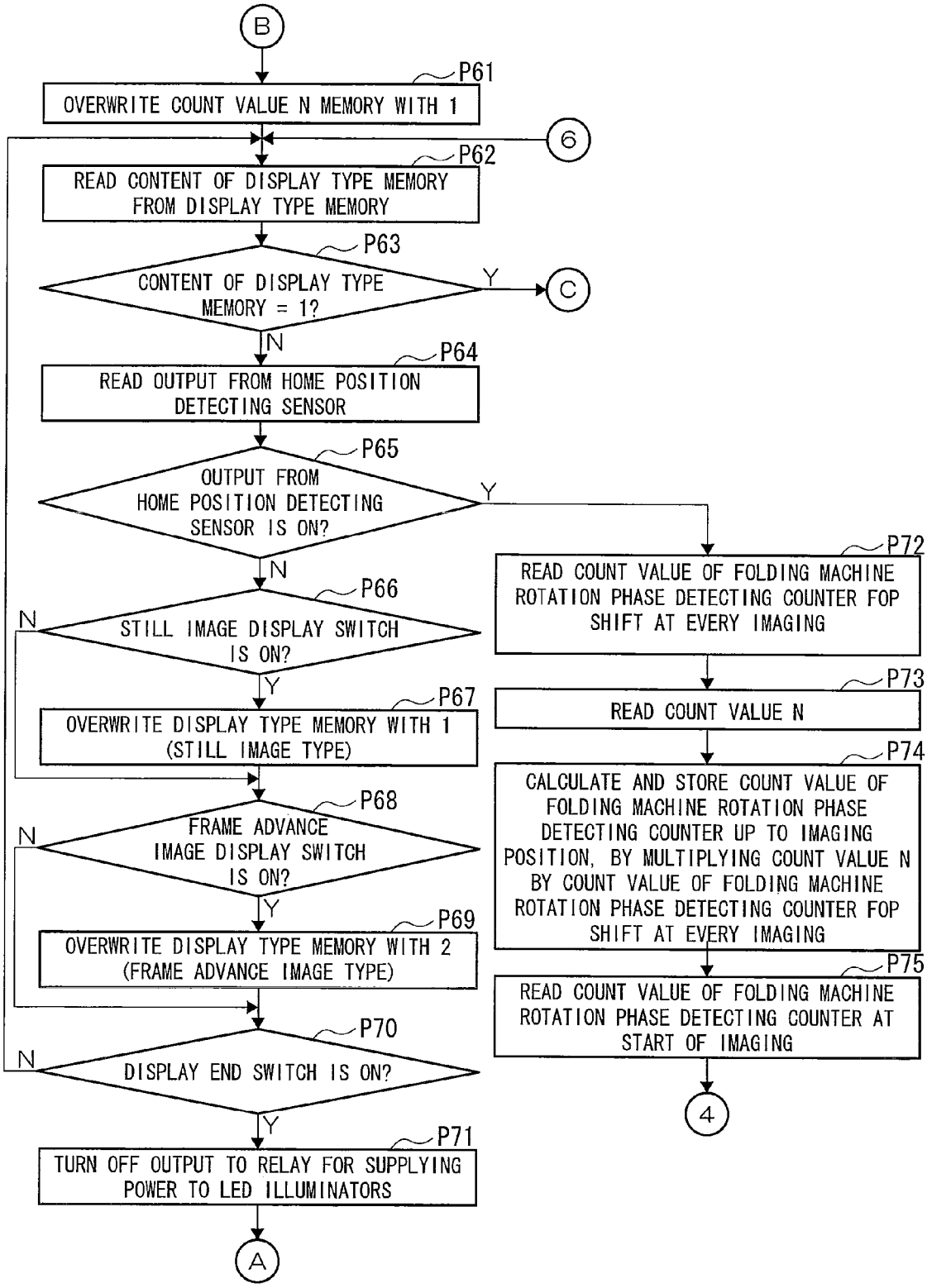
FIG. 11A is a flowchart showing operations of the control device.
Figure 11B:
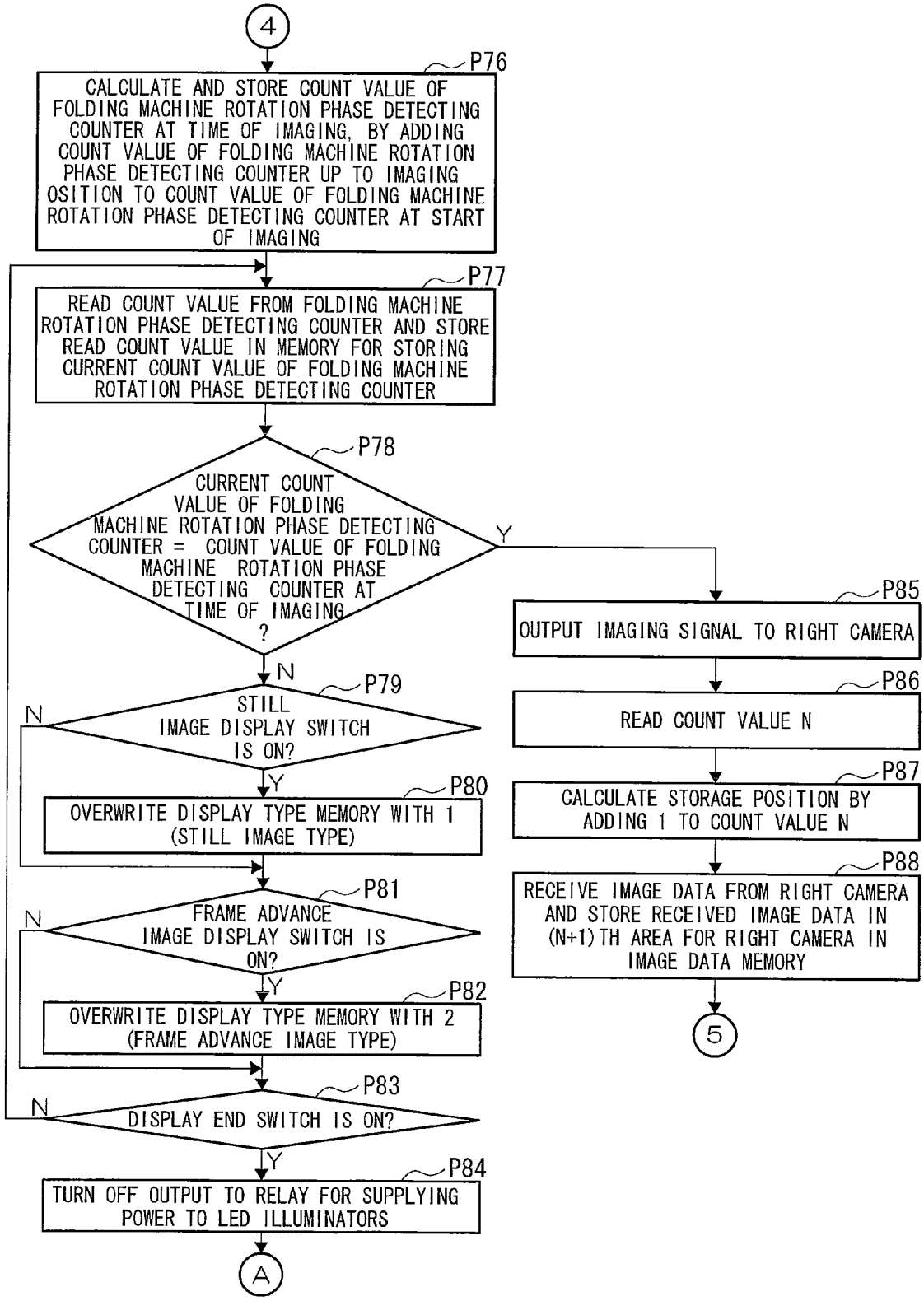
FIG. 11B is a flowchart showing operations of the control device.
Figure 11C:
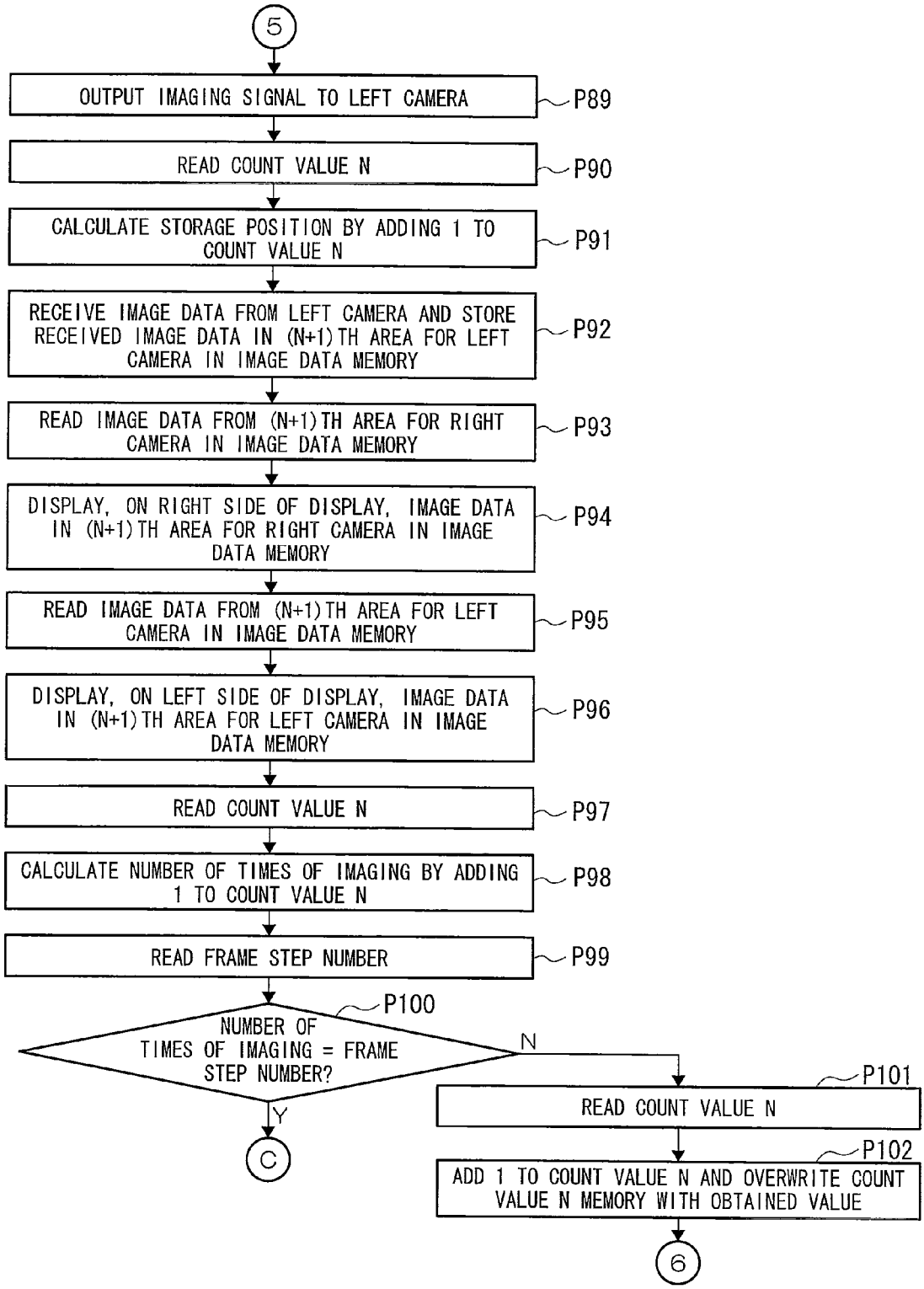
FIG. 11C is a flowchart showing operations of the control device.

FIG. 1 is a back view of a chopper folding device in a folding machine according to an embodiment of the present invention. FIG. 2 is a side view of the chopper folding device in the folding machine. FIG. 3 is a plan view of the chopper folding device in the folding machine. FIG. 4A is an explanatory view of a support mechanism of an LED illuminator. FIG. 4B is a view seen from an arrow A in FIG. 4A. FIG. 5A is an explanatory view of a support mechanism of a camera. FIG. 5B is a view seen from an arrow B in FIG. 5A. FIG. 6 is a side view of a schematic configuration of the folding machine. FIG. 7 is a back view of the schematic configuration of the folding machine. FIG. 8A is an explanatory view of an image showing a good behavior of a signature. FIG. 8B is an explanatory view of an image showing a bad behavior of a signature. FIGS. 9A and 9B are block diagrams of a control device. FIGS. 10A to 10D are flowcharts showing operations of the control device. FIGS. 11A to 11C are flowcharts showing operations of the control device.

As shown in FIGS. 6 and 7, a web Wa cooled and dried after being printed and then guided to an entry part of the folding machine is transported through a pair of upper nip rollers 10, a pair of cross perforation cylinders 11 and a pair of lower nip rollers 12. Thus, the web Wa is conveyed to a parallel-folding device 13 for cutting or folding the web into a predetermined size.

The parallel-folding device 13 includes a cut-off cylinder 14, a folding cylinder 15, a first jaw cylinder 16 and a second jaw cylinder 17, which are rotated in directions indicated by arrows in FIG. 6, respectively.

The web Wa fed into between the cut-off cylinder 14 and the folding cylinder 15 is cut into a predetermined size by an unillustrated cut-off knife of the cut-off cylinder 14. Moreover, the web Wa is wrapped around a lower circumferential surface of the folding cylinder 15 while being held by an unillustrated needles of the folding cylinder 15.

A signature (sheet) held by the needles is then gripped by an unillustrated gripper board of the first jaw cylinder 16 in cooperation with an unillustrated knife of the folding cylinder 15. Thus, while being folded in two or three, the signature as a signature Wb (see FIGS. 8A and 8B: sheet) is provided on an upper circumferential surface of the first jaw cylinder 16. Note that, a predetermined number of unillustrated knives are also provided at positions that equally divide the circumferential surface of the first jaw cylinder 16.

The second jaw cylinder 17 described above abuts on a downstream side of the first jaw cylinder 16. Moreover, pairs of upper and lower upstream-side conveying belts 18A and pairs of upper and lower downstream-side conveying belts 18B are provided at a downstream side of the second jaw cylinder 17. Furthermore, a chopper folding device 19 is provided at a position shifted toward a front part of the downstream-side conveying belt 18B from the center thereof.

Multiple pairs of upstream-side conveying belts 18A and multiple pairs of downstream-side conveying belts 18B are provided at intervals in a direction perpendicular to a conveying direction of the signature Wb. Each pair of the conveying belts 18A and 18B convey the signature Wb while sandwiching the signature therebetween. The chopper folding device 19 includes a chopper blade 19*a* for folding the signature Wb in a direction parallel to the conveying direction of the signature Wb, the signature Wb being stopped by stoppers 32 (see FIG. 3) to be described later.

Immediately below the chopper folding device 19, a delivery device 23 for discharging A4 paper, for example, is provided through a pair of left and right conveying belts 20, the delivery device 23 including fan wheels 21 and a conveyor 22. Moreover, at a downstream side of the chopper folding device 19, a delivery device 27 for discharging A3 paper, for example, is provided through a pair of front and rear conveying belts 24, the delivery device 27 including fan wheels 25 and a conveyor 26. Note that, the conveying belts 20 and the conveying belts 24 have the same configuration as that of the upstream-side and downstream-side pairs of conveying belts 18A and 18B described above.

At each of positions that equally divide the circumferential surface of the second jaw cylinder 17, a predetermined number of unillustrated grippers and gripper boards are provided.

Moreover, in the first jaw cylinder 16, an unillustrated cam mechanism is provided. The cam mechanism enables switching between delta-folding and single-parallel and double-parallel folding by switching, in two stages, a rotation phase (position) of a gripper opening in the gripper board of the first jaw cylinder 16.

Here, the folding cylinder 15 has a double-cylinder structure which also enables adjustment of a positional relationship between the unillustrated needles and knives according to the fold specification. Moreover, the second jaw cylinder 17 has an unillustrated cam mechanism which also controls the grippers and gripper boards to be switched in three stages according to the fold specification.

Specifically, in double-parallel folding and delta-folding, the signature is further folded by the knives of the first jaw cylinder 16 and the gripper boards of the second jaw cylinder 17. When the signature is folded, the gripper board of the first jaw cylinder 16 is opened.

Moreover, in the chopper folding device 19, a pair of right and left cameras (imaging means) 30A and 30B is provided together with a pair of LED illuminators 31 to be described later. Specifically, the cameras take images respectively of a range (see imaging ranges E in FIGS. 8A and 8B) where a conveying direction leading edge of one side edge parallel to the conveying direction of the signature Wb is decelerated or stopped by coming into contact with the stoppers, and a range where a conveying direction leading edge of the other side edge parallel to the conveying direction of the signature Wb is decelerated or stopped by coming into contact with the stoppers, when the signature Wb comes into contact with the stopper 32.

Specifically, first, as shown in FIG. 3, a support shaft 34 extending in a horizontal direction is provided in a delivery side frame 33*a* of a chopper sub-unit. One end of the support shaft 34 is supported by the delivery side frame 33*a* through a spherical bearing (not shown) and the other end thereof is coupled to an angle adjustor 36 attached to the delivery side frame 33*a* through a universal joint 35. Moreover, the stoppers 32 described above are supported by left and right parts of the support shaft 34 through brackets 37.

Thus, the angle adjustor 36 adjusts the angle of the stoppers 32 in a way that, using one end of the support shaft 34 as a fulcrum, the other end of the support shaft 34 is horizontally swung in a longitudinal direction. Note that a group of several stoppers 32 each arranged between the multiple downstream-side conveying belts 18B are integrated above the belts, and stop the signature Wb conveyed by the downstream-side conveying belts 18B by coming into contact therewith.

Moreover, as shown in FIGS. 1 to 3, hangers 40A and 40B are provided between the delivery side frame 33*a* of the chopper sub-unit and a folding machine-side frame 33*b*. Specifically, the hangers 40A and 40B are positioned in the left and right parts between the delivery side frame 33*a* and the folding machine-side frame 33*b*, and formed by assembling pipes or rod-shaped members in an L shape when viewed from the back. The cameras 30A and 30B described above are supported by the hangers 40A and 40B so as to be paired up with the pair of front and rear LED illuminators 31 for illuminating the imaging ranges E, respectively.

The hangers 40A and 40B are rotatably supported by the frames 33*a* and 33*b* through brackets 41 at one ends (upper parts) of a pair of front and rear L-shaped portions 50*a*. Moreover, the hangers 40A and 40B can be fixed by a fixing mechanism such as handles 42 at predetermined rotating positions (see retreat positions indicated by chained lines in FIG. 1).

Meanwhile, at working positions of the hangers 40A and 40B (imaging positions of the cameras 30A and 30B) indicated by solid lines in FIGS. 1 to 3, the hangers 40A and 40B can be fixed to the frames 33*a* and 33*b* through brackets 43 by a fixing mechanism such as handles 44 in C-shaped portions 50*b* attached to the other ends (lower parts) of the pair of front and rear L-shaped portions 50*a*.

On a lower shaft portion 50*c* of a pair of upper and lower shaft portions 50*c* connecting the other ends (lower parts) of the pair of front and rear L-shaped portions 50*a* of the hangers 40A and 40B, a split clamping holder 45 and the camera 30A (30B) described above are supported as shown in FIGS. 5A and 5B. Specifically, the camera 30A (30B) is supported through an L-shaped bracket 46 having a pin part split-clamped to the split clamping holder 45.

Therefore, axial movement of the split clamping holder 45 on the lower shaft portion 50*c* enables longitudinal fine adjustment of a shooting position of each of the cameras 30A and 30B. At the same time, rotation of the split clamping holder 45 around the shaft of the lower shaft portion 50*c* enables vertical fine adjustment of a shooting angle of each of the cameras 30A and 30B. Moreover, axial movement of the pin part of the L-shaped bracket 46 enables vertical adjustment of the shooting position of each of the cameras 30A and 30B. At the same time, rotation of the pin part around the shaft of the L-shaped bracket 46 enables longitudinal fine adjustment of the shooting angle of each of the cameras 30A and 30B.

As the cameras 30A and 30B, small monochrome cameras with electronic shutters or the like, which realize high resolution and fast readout, are used.

As shown in FIGS. 4A and 4B, each of the LED illuminators 31 is supported by a vertical shaft 49 supported by a pair of upper and lower second split clamping holders 48 through a pair of upper and lower first split clamping holders 47. Moreover, the pair of upper and lower second split clamping holders 48 is split-clamped to the pair of upper and lower shaft portions 50*c* of the hanger 40A (40B).

Therefore, axial movement of the pair of upper and lower second split clamping holders 48 on the pair of upper and lower shaft portions 50*c* enables longitudinal fine adjustment of an illuminating position of the LED illuminator 31. At the same time, axial movement of the second split clamping holders 48 on the vertical shaft 49 enables vertical fine adjustment of the illuminating position of the LED illuminator 31. Moreover, rotation of the pair of upper and lower first split clamping holders 47 around the vertical shaft 49 enables longitudinal fine adjustment of an illuminating angle of the LED illuminator 31.

Moreover, the cameras 30A and 30B and the LED illuminators 31 are shielded from the outside by case-like covers 51 fixed to the pairs of front and rear C-shaped portions 50*b* of the hangers 40A and 40B, respectively. Handles 52 for moving the hangers 40A and 40B between their working positions and retreat positions are attached to the covers 51. Note that a reference numeral 53 in FIG. 1 denotes a pair of left and right brushes (stopper front guides) which applies brake force to the signature Wb to be conveyed. A vertical height (in other words, brush pressure=brake force) of the brushes 53 can be adjusted by an adjustor 54.

The cameras 30A and 30B and the LED illuminators 31 are connected to a control device 60 to be described later. The control device 60 can control an imaging timing of the cameras 30A and 30B, switching of display types when an image taken by the cameras 30A and 30B is displayed on a display 70 (see FIG. 9A) such as a CRT and a display, and power supply to the LED illuminators 31.

The display 70 is provided in an operation stand operated by an operator. Therefore, the sheet monitor for the folding machine is formed of the cameras 30A and 30B, the LED illuminators 31, the control device 60, the display 70 and the like.

The operator monitors in real time the image displayed on the display 70. For example, as shown in FIG. 8A, when a distance $L_1$ between the conveying direction leading edge of the one side edge of the signature Wb and the stopper 32 is equal to a distance $L_2$ between the conveying direction leading edge of the other side edge of the signature Wb and the stopper 32, the operator determines OK. On the other hand, as shown in FIG. 8B, when the distance $L_1$ between the conveying direction leading edge of the one side edge of the signature Wb and the stopper 32 is not equal to the distance $L_2$ between the conveying direction leading edge of the other side edge of the signature Wb and the stopper 32, the operator determines NG. In the case of NG, the brush pressure=brake force on the $L_2$ side (see downward arrows in FIG. 8B) may be increased if the $L_1$ is longer, for example. Thus, $L_1=L_2$ is satisfied and the signature Wb is chopper-folded at a normal chopper folding position F.

As shown in FIGS. 9A and 9B, the control device 60 includes a CPU 61, a ROM 62, a RAM 63 and I/O units 64*a* to 64*e*, which are connected to each other via a bus line. A display type memory M1, a memory M2 for storing a folding machine rotation phase at the start of imaging, a memory M3 for storing a count value of a folding machine rotation phase detecting counter at the start of imaging, a memory M4 for storing a folding machine rotation phase at the end of imaging, and a memory M5 for storing a count value of the folding machine rotation phase detecting counter at the end of imaging are connected to the bus line.

A memory M6 for storing a count value difference of the folding machine rotation phase detecting counter during imaging, a memory M7 for storing a frame step number, a memory M8 for storing a count value of the folding machine rotation phase detecting counter for shift at every imaging, a memory M9 for storing a folding machine rotation phase at the time of imaging of a still image, and a memory M10 for storing a count value of the folding machine rotation phase detecting counter at the time of imaging of the still image are further connected to the bus line.

A memory M11 for storing a count value of a counter for detecting a current folding machine rotation phase, an image data memory M12, a count value N memory M13, a memory M14 for storing a count value of the folding machine rotation phase detecting counter up to an imaging position, and a memory M15 for storing a count value of the folding machine rotation phase detecting counter at the time of imaging are further connected to the bus line.

A display start switch 65, a still image display switch 66, a frame advance image display switch 67, a display end switch 68, an input unit 69 such as a keyboard, the display 70 such as the CRT and the display, and an output unit 71 such as a printer and a floppy disk (registered trademark) drive are connected to the I/O unit 64*a*.

A home position detecting sensor 72 is connected to the I/O unit 64*b*. Note that the home position detecting sensor 72 is formed of a photoelectric sensor or the like, and is attached to a rotary member of the folding machine so as to generate a pulse for every rotation of the folding machine. Here, one rotation of the folding machine means a rotation from start of folding of one signature by the chopper folding device 19 to start of folding of a next signature.

A folding machine rotation phase detecting rotary encoder 74 is connected to the I/O unit 64*c* through a folding machine rotation phase detecting counter 73. The folding machine rotation phase detecting counter 73 is also connected to the home position detecting sensor 72. Note that the folding machine rotation phase detecting rotary encoder 74 is attached to the rotary member of the folding machine so as to be rotated once for every rotation of the folding machine.

The right-side camera (including a camera control device) 30A and the left-side camera (including a camera control device) 30B are connected to the I/O unit 64*d*.

A relay 75 for supplying power to the LED illuminators is connected to the I/O unit 64*e*.

Control operations executed by the control device 60 as described above will be described in detail with reference to FIGS. 10A to 10D and FIGS. 11A to 11C.

First, after the display type memory M1 is overwritten with 1 (still image type) in Step P1, it is determined whether or not the display start switch 65 is ON in Step P2. Here, if a result of the determination is positive, the operation moves to Step P7 to be described later. On the other hand, if the result of the determination is negative, it is determined whether or not the still image display switch 66 is ON in Step P3.

Next, if a result of the determination in Step P3 is positive, the display type memory M1 is overwritten with 1 (still image type) in Step P4. Thereafter, it is determined whether or not the frame advance image display switch 67 is ON in Step P5. On the other hand, if the result of the determination in Step P3 is negative, the operation immediately moves to Step P5.

Thereafter, if a result of the determination in Step P5 is positive, the display type memory M1 is overwritten with 2 (frame advance image type) in Step P6. Thereafter, the operation returns to Step P2. On the other hand, if the result of the determination in Step P5 is negative, the operation immediately returns to Step P2.

When an output to the relay 75 for supplying power to the LED illuminators is turned ON in Step P7 described above, a folding machine rotation phase at the start of imaging is read from the memory M2 in Step P8. Thereafter, a count value of the folding machine rotation phase detecting counter at the start of imaging is calculated based on the folding machine rotation phase at the start of imaging and stored in the memory M3 in Step P9.

Subsequently, after a folding machine rotation phase at the end of imaging is read from the memory M4 in Step P10, a count value of the folding machine rotation phase detecting counter at the end of imaging is calculated based on the folding machine rotation phase at the end of imaging and stored in the memory M5 in Step P11.

Next, in Step P12, a count value difference of the folding machine rotation phase detecting counter during imaging is calculated by subtracting the count value of the folding machine rotation phase detecting counter at the start of imaging from the count value of the folding machine rotation phase detecting counter at the end of imaging, and is stored in the memory M6. Thereafter, in Step P13, a frame step number is read from the memory M7.

Subsequently, in Step P14, a count value of the folding machine rotation phase detecting counter for shift at every imaging is calculated by dividing the count value difference of the folding machine rotation phase detecting counter during imaging by the frame step number, and is stored in the memory M8. Thereafter, in Step P15, a folding machine rotation phase at the time of imaging of a still image is read from the memory M9. Note that the folding machine rotation phase at the time of imaging of the still image is a rotation phase in which the conveying direction leading edge of the signature Wb conveyed in a normal state come close to the stopper 32 as shown in FIG. 8A.

Next, in Step P16, a count value of the folding machine rotation phase detecting counter at the time of imaging of the still image is calculated based on the folding machine rotation phase at the time of imaging of the still image, and is stored in the memory M10. By the operation flow described above, the imaging timing for the cameras 30A and 30B of the both display types (the still image type and the frame advance image type) is initialized.

Next, after an output from the home position detecting sensor 72 is read in Step P17, it is determined whether or not the output from the home position detecting sensor 72 is ON in Step P18. If a result of the determination is positive, the operation moves to Step P25 to be described later. On the other hand, if the result of the determination is negative, it is determined whether or not the still image display switch 66 is ON in Step P19.

Next, if a result of the determination in Step P19 is positive, the display type memory M1 is overwritten with 1 (still image type) in Step P20. Thereafter, it is determined whether or not the frame advance image display switch 67 is ON in Step P21. On the other hand, if the result of the determination in Step P19 is negative, the operation immediately moves to Step P21.

Thereafter, if a result of the determination in Step P21 is positive, the display type memory M1 is overwritten with 2 (frame advance image type) in Step P22. Thereafter, it is determined whether or not the display end switch 68 is ON in Step P23. On the other hand, if the result of the determination in Step P21 is negative, the operation immediately moves to Step P23.

If a result of the determination in Step P23 is positive, the output to the relay 75 for supplying power to the LED illuminators is turned OFF in Step P24 and the operation returns to Step P2. On the other hand, if the result of the determination in Step P23 is negative, the operation returns to Step P17.

Next, after a content of the display type memory M1 is read from the display type memory M1 in Step P25 described above, it is determined whether or not the content of the display type memory=1 in Step P26.

If a result of the determination in Step P26 is positive, a count value is read from the folding machine rotation phase detecting counter 73 in Step P27 and is stored in the memory M11 for storing a count value of a counter for detecting a current folding machine rotation phase. On the other hand, if the result of the determination in Step P26 is negative, the operation moves to Step P44 to be described later.

Next, after the count value of the folding machine rotation phase detecting counter at the time of imaging of the still image is read from the memory M10 in Step P28, it is determined in Step P29 whether or not the count value of the counter for detecting the current folding machine rotation phase is equal to the count value of the folding machine rotation phase detecting counter at the time of imaging of the still image.

If a result of the determination in Step P29 is positive, the operation moves to Step P36 to be described later. On the other hand, if the result of the determination in Step P29 is negative, it is determined whether or not the still image display switch 66 is ON in Step P30. If a result of the determination in Step P30 is positive, the display type memory M1 is overwritten with 1 (still image type) in Step P31. Thereafter, it is determined whether or not the frame advance image display switch 67 is ON in Step P32. On the other hand, if the result of the determination in Step P30 is negative, the operation immediately moves to Step P32.

If a result of the determination in Step P32 is positive, the display type memory M1 is overwritten with 2 (frame advance image type) in Step P33. Thereafter, it is determined whether or not the display end switch 68 is ON in Step P34. On the other hand, if the result of the determination in Step P32 is negative, the operation immediately moves to Step P34.

If a result of the determination in Step P34 is positive, the output to the relay 75 for supplying power to the LED illuminators is turned OFF in Step P35 and the operation returns to Step P2. On the other hand, if the result of the determination in Step P34 is negative, the operation returns to Step P27.

Next, an imaging signal is outputted to the right camera 30A in Step P36 described above. Thereafter, in Step P37, image data is received from the right camera 30A and is stored in a first area for the right camera in the image data memory M12.

Subsequently, an imaging signal is outputted to the left camera 30B in Step P38. Thereafter, in Step P39, image data is received from the left camera 30B and is stored in a first area for the left camera in the image data memory M12.

Next, in Step P40, the image data is read from the first area for the right camera in the image data memory M12. Thereafter, in Step P41, the image data in the first area for the right camera in the image data memory M12 is displayed on the right side of the display 70.

Subsequently, in Step P42, the image data is read from the first area for the left camera in the image data memory M12. Thereafter, in Step P43, the image data in the first area for the left camera in the image data memory M12 is displayed on the left side of the display 70. Thereafter, the operation returns to Step P17.

When the content of the display type memory M1 is 1, in other words, when the still image type is selected as the display type, the loop including Steps P17, P18, P25 to P29 and P36 to P43 executed in this order allows the cameras 30A and 30B to always takes images in the folding machine rotation phase at the time of imaging of the still image and also allows the display 70 to display those images. Thus, the image data is displayed on the display 70 as if still images were displayed thereon.

Next, in Step P44 described above, the count value is read from the folding machine rotation phase detecting counter 73 and is stored in the memory M11 for storing the count value of the counter for detecting the current folding machine rotation phase. Thereafter, in Step P45, the count value of the folding machine rotation phase detecting counter at the start of imaging is read from the memory M3.

Next, it is determined in Step P46 whether or not the count value of the counter for detecting the current folding machine rotation phase is equal to the count value of the folding machine rotation phase detecting counter at the start of imaging. If a result of the determination in Step P46 is positive, the operation moves to Step P53 to be described later. On the other hand, if the result of the determination in Step P46 is negative, it is determined whether or not the still image display switch 66 is ON in Step P47.

If a result of the determination in Step P47 is positive, the display type memory M1 is overwritten with 1 (still image type) in Step P48. Thereafter, it is determined whether or not the frame advance image display switch 67 is ON in Step P49. On the other hand, if the result of the determination in Step P47 is negative, the operation immediately moves to Step P49.

If a result of the determination in Step P49 is positive, the display type memory M1 is overwritten with 2 (frame advance image type) in Step P50. Thereafter, it is determined whether or not the display end switch 68 is ON in Step P51. On the other hand, if the result of the determination in Step P49 is negative, the operation immediately moves to Step P51.

If a result of the determination in Step P51 is positive, the output to the relay 75 for supplying power to the LED illuminators is turned OFF in Step P52 and the operation returns to Step P2. On the other hand, if the result of the determination in Step P51 is negative, the operation returns to Step P44.

Next, an imaging signal is outputted to the right camera 30A in Step P53 described above. Thereafter, in Step P54, image data is received from the right camera 30A and is stored in the first area for the right camera in the image data memory M12.

Subsequently, an imaging signal is outputted to the left camera 30B in Step P55. Thereafter, in Step P56, image data is received from the left camera 30B and is stored in the first area for the left camera in the image data memory M12.

Next, in Step P57, the image data is read from the first area for the right camera in the image data memory M12. Thereafter, in Step P58, the image data in the first area for the right camera in the image data memory M12 is displayed on the right side of the display 70.

Subsequently, in Step P59, the image data is read from the first area for the left camera in the image data memory M12. Thereafter, in Step P60, the image data in the first area for the left camera in the image data memory M12 is displayed on the left side of the display 70. Thereafter, the operation moves to Step P61 to be described later.

Next, after the count value N memory M13 is overwritten with 1 in Step P61 described above, a content of the display type memory M1 is read from the display type memory M1 in Step P62.

Thereafter, it is determined whether or not the content of the display type memory is equal to 1 in Step P63. If a result of the determination in Step P63 is positive, the operation returns to Step P17. On the other hand, if the result of the determination in Step P63 is negative, an output from the home position detecting sensor 72 is read in Step P64.

Subsequently, it is determined whether or not the output from the home position detecting sensor 72 is ON in Step P65. If a result of the determination in Step P65 is positive, the operation moves to Step P72 to be described later. On the other hand, if the result of the determination in Step P65 is negative, it is determined whether or not the still image display switch 66 is ON in Step P66.

Next, if a result of the determination in Step P66 is positive, the display type memory M1 is overwritten with 1 (still image type) in Step P67. Thereafter, it is determined whether or not the frame advance image display switch 67 is ON in Step P68. On the other hand, if the result of the determination in Step P66 is negative, the operation immediately moves to Step P68.

If a result of the determination in Step P68 is positive, the display type memory M1 is overwritten with 2 (frame advance image type) in Step P69. Thereafter, it is determined whether or not the display end switch 68 is ON in Step P70. On the other hand, if the result of the determination in Step P68 is negative, the operation immediately moves to Step P70.

If a result of the determination in Step P70 is positive, the output to the relay 75 for supplying power to the LED illuminators is turned OFF in Step P71 and the operation returns to Step P2. On the other hand, if the result of the determination in Step P70 is negative, the operation returns to Step P62.

Subsequently, in Step P72 described above, the count value of the folding machine rotation phase detecting counter for shift at every imaging is read from the memory M8. Thereafter, the count value N is read from the memory M13 in Step P73.

Next, in Step P74, a count value of the folding machine rotation phase detecting counter up to an imaging position is calculated by multiplying the count value N by the count value of the folding machine rotation phase detecting counter for shift at every imaging, and is stored in the memory M14. Thereafter, in Step P75, the count value of the folding machine rotation phase detecting counter at the start of imaging is read from the memory M3.

Next, in Step P76, a count value of the folding machine rotation phase detecting counter at the time of imaging is calculated by adding the count value of the folding machine rotation phase detecting counter up to the imaging position to the count value of the folding machine rotation phase detecting counter at the start of imaging, and is stored in the memory M15. Thereafter, in Step P77, a count value is read from the folding machine rotation phase detecting counter 73 and is stored in the memory M11 for storing a count value of the counter for detecting a current folding machine rotation phase.

Thereafter, it is determined in Step P78 whether or not the count value of the counter for detecting the current folding machine rotation phase is equal to the count value of the folding machine rotation phase detecting counter at the time of imaging. If a result of the determination in Step P78 is positive, the operation moves to Step P85 to be described later. On the other hand, if the result of the determination in Step P78 is negative, it is determined whether or not the still image display switch 66 is ON in Step P79.

If a result of the determination in Step P79 is positive, the display type memory M1 is overwritten with 1 (still image type) in Step P80. Thereafter, it is determined whether or not the frame advance image display switch 67 is ON in Step P81. On the other hand, if the result of the determination in Step P79 is negative, the operation immediately moves to Step P81.

If a result of the determination in Step P81 is positive, the display type memory M1 is overwritten with 2 (frame advance image type) in Step P82. Thereafter, it is determined whether or not the display end switch 68 is ON in Step P83. On the other hand, if the result of the determination in Step P81 is negative, the operation immediately moves to Step P83.

If a result of the determination in Step P83 is positive, the output to the relay 75 for supplying power to the LED illuminators is turned OFF in Step P84 and the operation returns to Step P2. On the other hand, if the result of the determination in Step P83 is negative, the operation returns to Step P77.

Next, after an imaging signal is outputted to the right camera 30A in Step P85 described above, the count value N is read from the memory M13 in Step P86.

Thereafter, in Step P87, a storage position is calculated by adding 1 to the count value N. Subsequently, in Step P88, image data is received from the right camera 30A and is stored in a $(N+1)^{th}$ area for the right camera in the image data memory M12.

Next, after an imaging signal is outputted to the left camera 30B in Step P89, the count value N is read from the memory M13 in Step P90.

Thereafter, in Step P91, a storage position is calculated by adding 1 to the count value N. Subsequently, in Step P92, image data is received from the left camera 30B and is stored in a $(N+1)^{th}$ area for the left camera in the image data memory M12.

Next, in Step P93, the image data is read from the $(N+1)^{th}$ area for the right camera in the image data memory M12. Thereafter, in Step P94, the image data in the $(N+1)^{th}$ area for the right camera in the image data memory M12 is displayed on the right side of the display 70.

Subsequently, in Step P95, the image data is read from the $(N+1)^{th}$ area for the left camera in the image data memory M12. Thereafter, in Step P96, the image data in the $(N+1)^{th}$ area for the left camera in the image data memory M12 is displayed on the left side of the display 70.

After the count value N is read from the memory M13 in Step P97, the number of times of imaging is calculated by adding 1 to the count value N in Step P98.

Next, after the frame step number is read from the memory M7 in Step P99, it is determined whether or not the number of times of imaging is equal to the frame step number in Step P100.

If a result of the determination in Step P100 is positive, the operation returns to Step P17. On the other hand, if the result of the determination in Step P100 is negative, the count value N is read from the memory M13 in Step P101. Thereafter, in Step P102, 1 is added to the count value N and the count value N memory M13 is overwritten with the obtained value. Subsequently, the operation returns to Step P62. Thereafter, the above operation is repeated.

When the content of the display type memory M1 is 2, in other words, when the frame advance image type is selected as the display type, the loop including Steps P17, P18, P25, P26, P44 to P46, P53 to P65, P72 to P78 and P85 to P102 executed in this order allows images to be taken by the cameras 30A and 30B by delaying a timing every time by a period corresponding to a fixed rotation phase and to be sequentially displayed on the display 70 in chronological order. Thus, the image data is displayed on the display 70 as if images were displayed frame by frame thereon. Moreover, the folding machine rotation phase for imaging the frame advance images includes a rotation phase approximately equal to the folding machine rotation phase at the time of imaging of the still image.

As described above, in this embodiment, based on the images taken by the right and left cameras 30A and 30B, the operator can monitor in real time the behavior (see FIGS. 8A and 8B) of the conveying direction leading edge of the signature Wb conveyed by the downstream-side conveying belts 18B before the signature Wb comes into contact with the stopper 32 in the chopper folding device 19.

Thus, the operator can promptly make a subsequent response (such as adjusting the brush pressure of any one of the left and right brushes 53 when the behavior is NG). As a result, burden on the operator can be reduced and waste sheets can be reduced.

Moreover, images of the conveying direction leading edge of the one side edge parallel to the conveying direction of the signature Wb and the conveying direction leading edge of the other side edge parallel to the conveying direction of the signature Wb are separately taken from obliquely above as shown in FIG. 7. Thus, the tilt degree of the signature Wb can be accurately monitored without hindrance from the chopper folding device 19.

Moreover, the cameras 30A and 30B take images once for each rotation of the folding machine (in other words, for each signature Wb). Thus, recognition of images is facilitated unlike the case where one signature Wb is imaged more than once (so-called continuously shot) at multiple positions under high-speed rotation of the folding machine.

Moreover, every time the cameras 30A and 30B take images once, the imaging position is shifted for each signature Wb by each taking every image at a later point in the folding machine rotation phase than that of the image immediately before taken. Accordingly, images thus taken can be displayed as so-called frame advance images in chronological order on the display 70. Thus, the behavior of the signature Wb can be comprehensively grasped along the flow thereof. As a result, accuracy of monitoring by the operator is significantly improved.

Moreover, since the display 70 is provided in the operation stand operated by the operator, monitoring by the operator is facilitated.

Moreover, the hangers 40A and 40B supporting the cameras 30A and 30B and the LED illuminators 31 can be moved from the working positions to the retreat positions. Thus, maintenance by the operator is facilitated.

Note that, needless to say, the present invention is not limited to the above embodiment and various changes, such as a structural change in the hangers 40A and 40B supporting the cameras 30A and 30B and the LED illuminators 31, can be made without departing from the scope of the present invention.

REFERENCE SIGNS LIST

13 PARALLEL-FOLDING DEVICE
14 CUT-OFF CYLINDER
15 FOLDING CYLINDER
16 FIRST JAW CYLINDER
17 SECOND JAW CYLINDER
18B PAIR OF UPPER AND LOWER DOWNSTREAM-SIDE CONVEYING BELT
19 CHOPPER FOLDING DEVICE
19*a* CHOPPER BLADE
21 FAN WHEEL
22 CONVEYOR
23 DELIVERY DEVICE FOR DISCHARGING A4 PAPER, FOR EXAMPLE
25 FAN WHEEL
26 CONVEYOR
27 DELIVERY DEVICE FOR DISCHARGING A3 PAPER, FOR EXAMPLE
30A RIGHT-SIDE CAMERA
30B LEFT-SIDE CAMERA
31 LED ILLUMINATOR
32 STOPPER
40A, 40B HANGER
53 BRUSH
60 CONTROL DEVICE
70 DISPLAY
Wa WEB
Wb SIGNATURE

The invention claimed is:

1. A sheet monitor for a folding machine, comprising:

a plurality of pairs of conveying belts, the pairs provided at intervals in a direction perpendicular to a conveying direction of a sheet and conveying the sheet while holding the sheet therebetween;

a plurality of stoppers being provided between the plurality of pairs of conveying belts and stopping the sheet conveyed by the plurality of pairs of conveying belts by coming into contact with the sheet;

a chopper blade folding the sheet stopped by the stoppers in a direction parallel to the conveying direction of the sheet;

a pair of imaging means taking images respectively of a range where a conveying direction leading edge of one side edge parallel to the conveying direction of the sheet is decelerated or stopped by coming into contact with the stoppers, and a range where a conveying direction leading edge of the other side edge parallel to the conveying direction of the sheet is decelerated or stopped by coming into contact with the stoppers; and a control unit that controls the pair of imaging means, wherein the control unit controls the pair of imaging means to take images once for each rotation of the folding machine, and wherein the control unit controls each of the pair of imaging means to take every image at a folding machine rotation phase different from that of the image immediately before taken.

2. The sheet monitor for a folding machine according to claim 1, wherein from obliquely above, the imaging means take images of the conveying direction leading edge of the one side edge parallel to the conveying direction of the sheet and the conveying direction leading edge of the other side edge parallel to the conveying direction of the sheet.

3. The sheet monitor for a folding machine according to claim 1, wherein the control unit controls each of the imaging means to take every image at a later point in the folding machine rotation phase than that of the image immediately before taken.

4. The sheet monitor for a folding machine according to claim 1, further comprising:

a display, wherein images taken by the pair of imaging means are displayed side-by-side on the display.

5. The sheet monitor for a folding machine according to claim 4, wherein the display displays the images, which are taken by the pair of imaging means, in chronological order.

6. The sheet monitor for a folding machine according to claim 5, wherein the display is provided in an operation stand operated by an operator.

* * * * *